US007844195B2

(12) United States Patent
Sasagawa

(10) Patent No.: US 7,844,195 B2
(45) Date of Patent: Nov. 30, 2010

(54) CLEANING MEMBER

(75) Inventor: Gouki Sasagawa, Shinagawa-ku (JP)

(73) Assignee: Synztec Co., Ltd., Tokyo (JP)

( * ) Notice: Subject to any disclaimer, the term of this patent is extended or adjusted under 35 U.S.C. 154(b) by 223 days.

(21) Appl. No.: 12/101,038

(22) Filed: Apr. 10, 2008

(65) Prior Publication Data

US 2008/0253817 A1 Oct. 16, 2008

(30) Foreign Application Priority Data

Apr. 12, 2007 (JP) ..... 2007-105256
Apr. 9, 2008 (JP) ..... 2008-101860

(51) Int. Cl.
*G03G 15/02* (2006.01)

(52) U.S. Cl. ..... 399/100; 399/357

(58) Field of Classification Search ..... 399/98–101, 399/123, 343, 357; 15/256.51, 256.52
See application file for complete search history.

(56) References Cited

U.S. PATENT DOCUMENTS 3,622,412 A * 11/1971 Ross et al. ..... 156/87
4,263,391 A * 4/1981 Saito et al. ..... 430/117.3
5,148,227 A * 9/1992 Senba et al. ..... 399/349
2009/0103941 A1 * 4/2009 Iwasaki et al. ..... 399/100

FOREIGN PATENT DOCUMENTS

JP 2847524 11/1998
JP 2006-64774 3/2006

* cited by examiner

*Primary Examiner*—Hoan Tran
(74) *Attorney, Agent, or Firm*—Sughrue Mion, PLLC

(57) ABSTRACT

The present invention provides a cleaning member which can be produced at low cost and which maintains excellent cleaning performance for a long period of time. The cleaning member has a lower layer formed through winding a double-faced tape formed of a sponge member having an adhesive layer on each side thereof around the surface of a core member, and an upper layer provided on the outer surface of the lower layer. The upper layer is formed of at least one fiber layer made of woven fabric or knitted fabric.

6 Claims, 3 Drawing Sheets

CLEANING MEMBER

The entire disclosure of Japanese Patent Applications Nos. 2007-105256 filed on Apr. 12, 2007 and 2008-101860 filed on Apr. 9, 2008 is expressly incorporated by reference herein.

BACKGROUND OF THE INVENTION

1. Field of the Invention

The present invention relates to a cleaning member for removing toner, additives, paper dust, etc. and more particularly to a cleaning member suitable for a cleaning roller for removing toner deposited on a charge-imparting roller employed in a copying machine, a printer, a facsimile, etc.

2. Background Art

Image-forming machines; for example, copying machines, printers, and complex office-automation (OA) machines having copying and printing functions, employ a cleaning blade or a cleaning roller. The cleaning roller removes toner, additives, paper dust, and other foreign matter deposited on a charge-imparting roller and a photoreceptor, through contact therewith. When the cleaning roller cannot sufficiently remove such foreign matter, members such as a charge-imparting roller and a photoreceptor are damaged, resulting in printed-image failures. Therefore, the cleaning roller is required to maintain its cleaning performance for a long period of time.

Japanese Patent No. 2847524 discloses a charge-imparting apparatus employing a cleaning member formed of sponge material, and Japanese Patent Application Laid-open (kokai) No. 2006-064774 discloses a toner-supplying roller including a cylindrical elastic member and a fiber layer formed of entangled melt-adhesive fiber.

In Japanese Patent No. 2847524, a hole is provided in a block of molded foam, and a core member is inserted in the hole. In Japanese Patent Application Laid-Open (kokai) No. 2006-064774, a molded roller is covered with melt-adhesive fiber, and the fiber-coated roller is heated again by use of a mold. These processes require a number of production steps, elevating production cost. In addition, since these rollers do not successfully hold removed foreign matter, the rollers cannot be used for a prolonged period of time.

SUMMARY OF THE INVENTION

In view of the foregoing, an object of the present invention is to provide a cleaning member which can be produced at low cost and which maintains excellent cleaning performance for a long period of time.

In a first mode of the present invention for attaining the object, there is provided a cleaning member comprising:

a core member, a lower layer formed through winding a double-faced tape around the core member at the surface thereof, and an upper layer provided on the outer surface of the lower layer, wherein the double-faced tape has a sponge member having an adhesive layer on each side thereof, and the upper layer is formed of at least one fiber layer made of woven fabric or knitted fabric.

A second mode of the invention is drawn to a specific embodiment of the cleaning member of the first mode, wherein the double-faced tape has a thickness of 0.4 to 3.0 mm.

A third mode of the invention is drawn to a specific embodiment of the cleaning member of the first or second mode, wherein the sponge member is formed of polyolefin or acrylic rubber.

A fourth mode of the invention is drawn to a specific embodiment of the cleaning member of any of the first to third modes, wherein the upper layer is formed of a plurality of fiber layers, whose materials or fabric types are identical to or different from one another.

A fifth mode of the invention is drawn to a specific embodiment of the cleaning member of any of the first to fourth modes, wherein the cleaning member has a roller shape.

The present invention realizes provision of a cleaning member which can be produced at low cost and which maintains excellent cleaning performance for a long period of time.

BRIEF DESCRIPTION OF THE DRAWINGS

Various other objects, features, and many of the attendant advantages of the present invention will be readily appreciated as the same becomes better understood with reference to the following detailed description of the preferred embodiments when considered in connection with the accompanying drawings, in which.

DETAILED DESCRIPTION OF PREFERRED EMBODIMENTS

The cleaning member according to the present invention includes a core member, a lower layer formed through winding a double-faced tape around the core member at the surface thereof, and an upper layer provided on the outer surface of the lower layer, wherein the double-faced tape includes a sponge member having an adhesive layer on each side thereof. By virtue of the lower layer and the upper layer, toner, additives, paper dust, and other foreign matter deposited on a member can be suitably removed through contact therewith, and such a good performance is maintained for a long period of time.

Hereinafter, taking a cleaning roller as an example of the cleaning member of the present invention, the present invention will be described in detail.

Figure 1A:
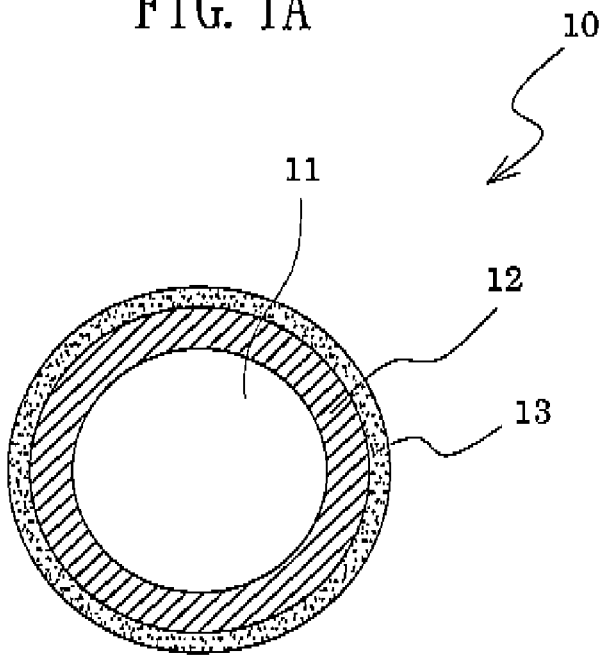
FIGS. 1A and 1B are sketches of a cleaning roller, which is an embodiment of the cleaning member of the present invention.
Figure 1B:
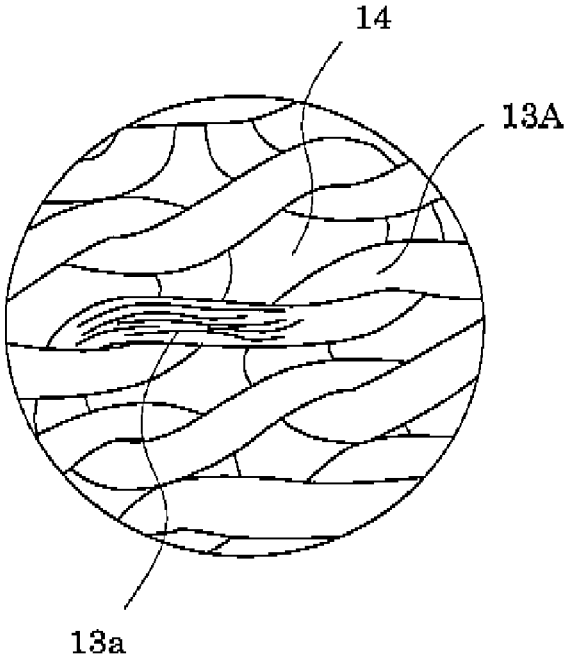

FIGS. 1A and 1B are sketches of a cleaning roller, which is an embodiment of the cleaning member of the present invention. FIG. 1A is a cross-section of the cleaning member, and FIG. 1B is a schematic enlarged view of a portion of the upper layer of the cleaning member.

As shown in FIG. 1A, a cleaning roller 10 has a lower layer 12 formed through winding, around the surface of a core member 11, a double-faced tape formed of a sponge member having an adhesive layer on each side thereof, and an upper layer 13 provided on the outer surface of the lower layer 12.

Figure 2A:
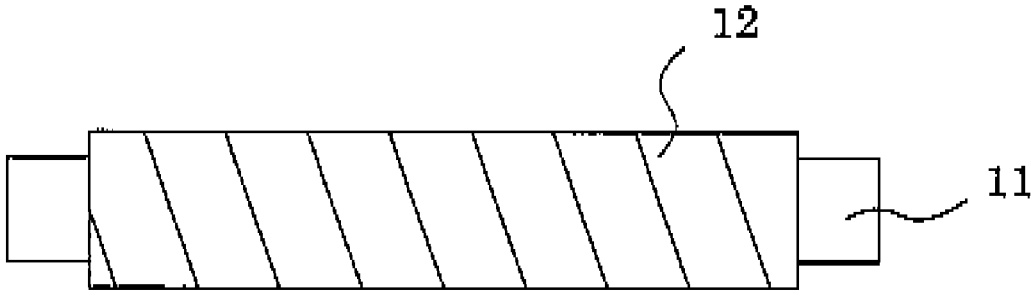
FIGS. 2A and 2B are sketches for illustrating the method of producing the cleaning roller shown in FIGS. 1A and 1B.
Figure 2B:
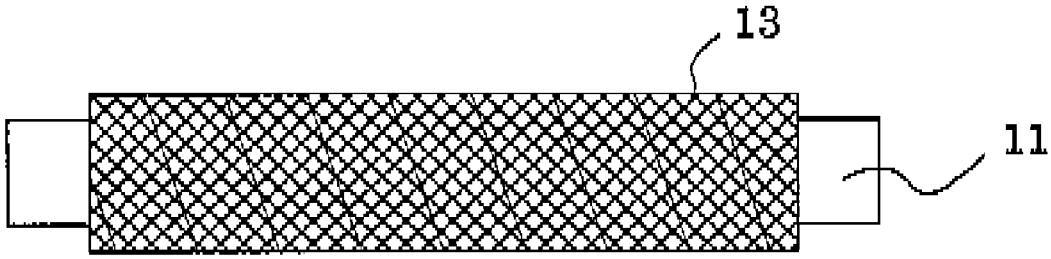

Referring to FIGS. 2A and 2B, the method for producing the cleaning roller 10 shown in FIGS. 1A and 13 will be briefly described. Firstly, as shown in FIG. 2A, the double-faced tape formed of a sponge member having an adhesive layer on each side thereof is spirally wound around the surface of the core member 11, to thereby form the lower layer 12. As shown in FIG. 2B, knitted fabric is attached and affixed to the lower layer 12, to thereby form the upper layer 13 on the lower layer 12, whereby the cleaning roller 10 is produced. Thus, the cleaning roller 10 of the present embodiment can be produced through a very small number of production steps, thereby lowering the production cost.

Needless to say, the cleaning roller 10 having the lower layer 12 and the upper layer 13 may be produced through affixing knitted fabric or similar material serving as the upper layer 13 on one side of the double-faced tape, and subsequently, winding the tape around the core member 11.

As described above, the lower layer 12 is formed of a double-faced tape having an adhesive layer on each side of a sponge member serving as a support, and replaces an elastic layer of a conventional cleaning member. Such a double-faced tape readily adheres on the core member 11, and the upper layer 13 readily adheres on the other side of the double-faced tape. In addition, the lower layer, formed of the adhesive layers and the sponge member, is readily wound around the surface of the core member 11.

The double-faced tape which serves as the lower layer 12 preferably has a thickness of 0.4 to 3.0 mm. Since the double-faced tape having such a thickness has a desired elasticity and other properties of the sponge member, cleaning performance of the surface of the cleaning roller can be fully attained. When a double-faced tape having a thickness of more than 3.0 mm is employed, a satisfactory cleaning effect can be attained. However, since a cleaning roller produced therefrom has a large roller diameter, such a cleaning roller is not suited for the purpose of down-sizing a complex OA machine. Needless to say, one or more species of double-faced tapes having a thickness smaller than the aforementioned thickness may be laminated in a number of two or more around a core member, so as to attain the aforementioned thickness.

Preferably, the sponge member has an Asker C hardness of 80° or less, and a permanent compressive strain of 30% or less, in order to ensure satisfactory deformation and facilitate resilience; i.e., to produce a lower layer 12 having good resilience.

The sponge member is preferably formed from polyolefin or acrylic rubber, since a suitable elasticity required for cleaning can be attained.

No particular limitation is imposed on the width of the double-faced tape, but the width is preferably about 5 to about 20 mm, in order to facilitate winding thereof around the core member.

As shown in FIG. 1B, the upper layer 13 of the present embodiment is formed of knitted fabric produced through knitting yarns 13A obtained through twisting fiber filaments 13*a*. The fiber filament 13*a* has a diameter of 5 μm to 100 μm and an aspect ratio (length/diameter) of 100 or more. In the present embodiment, yarn 13A is produced through twisting fiber filaments 13*a*.

The yarn 13A has a very small diameter. For example, the diameter (apparent thickness) is preferably 80 to 500 μm, for the following reasons. Since the particle size of the toner deposited on a contact member is, for example, 5 to 10 μm, such a thin yarn is suitable for scraping the toner of such a particle size. Also, space 14 provided by knitted yarn 13A having such a diameter effectively scrapes and captures toner and other foreign matter. In addition, such a small diameter enables the yarn to have sufficient strength for cleaning. When the yarn has an apparent thickness less than 80 μm, mechanical strength may decrease, whereas when the apparent thickness is in excess of 500 μm, softness of the upper layer 13 may be impaired, resulting in a drop in cleaning performance. Needless to say, both cases are not preferred.

In the aforementioned knitted fabric, the course width (μm) and the wale width (μm) are preferably 3 to 10 times the apparent thickness (μm) of the yarn 13A, particularly preferably 3 to 7 times. The apparent fiber thickness is not a diameter index (weight per unit fiber length) represented by d (denier) or dTex (deci-Tex), but an actual fiber thickness measured under a microscope or the like.

Figure 3A:
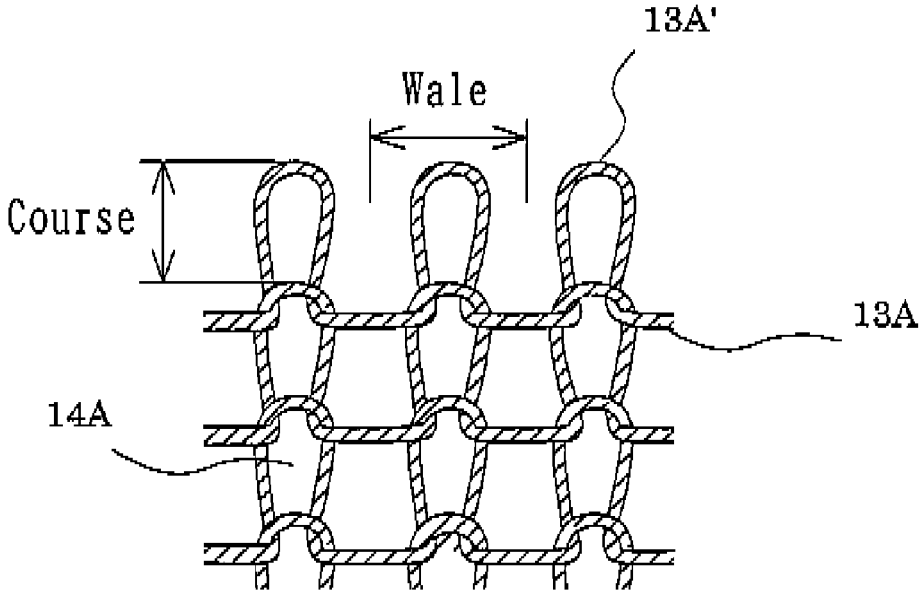
FIGS. 3A and 3B are schematic enlarged views of a portion of the upper layer of a cleaning roller.

As shown in FIG. 3A, the course refers to a row of loops 13A' in the lateral direction (lateral row), and the wale refers to a row of loops 13A' in the longitudinal direction (longitudinal row). The course width is a width of a lateral row; i.e., the distance between tops of the loops 13A', and the wale width is a width of a longitudinal row; i.e., the pitch of loops 13A'. When the knitted fabric has a course width and a wale width which are 3 to 10 times the apparent thickness of the yarn, the yarns 13A are not completely fixed but can move freely in the lateral and longitudinal directions. In this state, the yarns 13A can follow deformation. Thus, toner, paper dust, and other foreign matter deposited on a contact member can be readily scraped off through contact with the knitted fabric. Also, knitted fabric having a course width and a wale width which are 3 to 10 times the apparent thickness of the yarn provides relatively large spaces 14A. The scraped matter is received in the spaces 14A and readily falls through the spaces 14A into the inside of the upper layer 13. Thus, the scraped matter can be held in the lower layer 12 in a large amount. Therefore, the cleaning roller 10 can maintain the cleaning performance for a long period of time. Notably, knitted fabric having a course width and/or a wale width which are less than 3 times the apparent thickness of the yarn does not follow deformation of the yarn 13A and encounters difficulty in holding the scraped matter, whereas knitted fabric having a course width and/or a wale width which are more than 10 times the apparent thickness of the yarn follows deformation of the yarn to an improved extent, but has a decreased contact area with respect to a contact member, possibly lowering the cleaning performance.

No particular limitation is imposed on the knitting type of the knitted fabric, and example of the knitting type include plain stitch, rib stitch, tuck stitch, float stitch, half cardigan, interlock stitch, lace stitch, and pile stitch.

The cleaning roller of the present embodiment scrapes toner and other foreign matter deposited on a contact member through movement of the yarns 13A in a direction of rotation of the roller, to thereby clean the contact member. Specifically, toner and other foreign matter are captured by at least a first portion of fiber filaments 13*a* forming the yarn 13A, and a second portion of the filaments 13*a* sustains the first portion, while the cleaning roller 10 rotates. Thus, the toner and other foreign matter deposited on the contact member are scraped off, and the scraped matter falls in the spaces 14 provided by the yarns 13A. Thus, knitted fabric produced through knitting yarns 13A obtained through twisting fiber filaments 13*a* can successfully remove toner, additives, paper dust, and other foreign matter.

In the present embodiment, the upper layer 13 is formed from knitted fabric. Alternatively, the layer may be formed from woven fabric. Examples of the woven fabric include three essential structures (e.g., plain weave, twill weave, and satin weave) and combination weave.

Figure 3B:
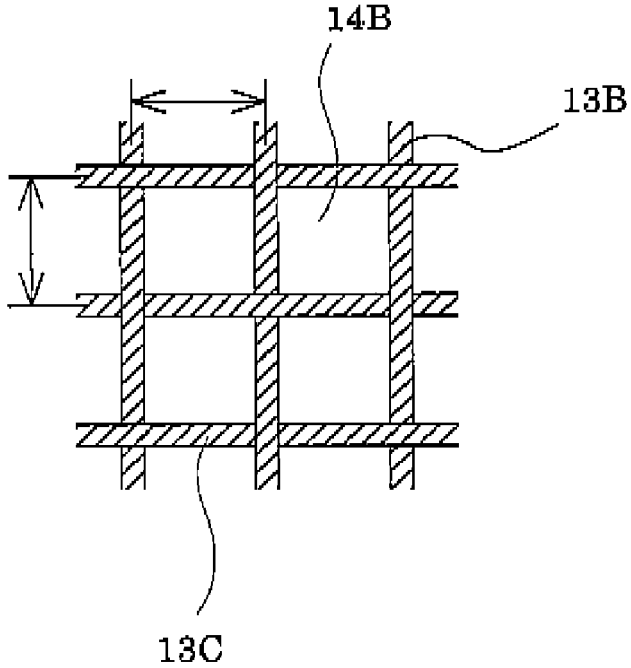

Preferably, the woven fabric has an interwarp distance (μm) which is 3 to 10 times the apparent thickness (μm) of the warp, and an interweft distance (μm) which is 3 to 10 times the apparent thickness (μm) of the weft. Particularly preferably, the distances are 3 to 7 times the apparent thickness. As shown in FIG. 3B, the distance between the warps 13B and the distance between the wefts 13C are the distance between width-direction centers of the yarns adjacent to each other. When the woven fabric has a distance (μm) between the warps 13B which is 3 to 10 times the apparent thickness (μm) of the warp 13B, and a distance (μm) between the wefts 13C which is 3 to 10 times the apparent thickness (μm) of the weft 13C, the warps 13B and wefts 13C are not completely fixed but can move freely in the lateral and longitudinal directions, and relatively large spaces 14B are provided. Therefore, the effects as mentioned in relation to the above embodiment can also be attained. Notably, woven fabric having a distance (μm) between the warps 13B which is less than 3 times the apparent thickness (μm) of the warp 13B or a distance (μm) between the wefts 13C which is less than 3 times the apparent thickness (μm) of the weft 13C does not follow deformation of the warp 13B or weft 13C and encounters difficulty in holding the scraped matter, whereas woven fabric having a distance (μm) between the warps 13B which is more than 10 times the apparent thickness (μm) of the warp 13B or a distance (μm) between the wefts 13C which is more than 10 times the apparent thickness (μm) of the weft 13C follows deformation of the warp 133 or weft 13C to an improved extent, but has a decreased contact area with respect to a contact member, possibly lowering the cleaning performance.

No particular limitation is imposed on the apparent thickness of the warps and wefts forming the woven fabric. In the woven fabric, the warp and the weft may be formed from different materials and may have different apparent thicknesses.

The yarn (knitted fabric), warp, and weft (woven fabric) forming the upper layer 13 are a bundle of fiber filaments. Needless to say, twisted yarn and knitted yarn may also be employed. So long as the cleaning performance is not impaired, fiber filaments including fancy fiber filaments may be bundled. The fiber filaments forming the yarn (knitted fabric), warp, and weft (woven fabric) preferably have a diameter of 5 to 100 μm. When the filament diameter is less than 5 μm, fiber strength is insufficient, whereas when the filament diameter is in excess of 100 μm, softness of the upper layer 13 may be impaired, resulting in a drop in cleaning performance.

So long as the cleaning performance is not impaired, the knitted fabric or the woven fabric may further include other types of fiber filaments, in addition to the yarn, warp, or weft satisfying the aforementioned conditions. Examples include a curly fiber filament which has a diameter smaller than that of the yarn, warp, or weft, or a raised fiber filament.

No particular limitation is imposed on the material of the yarn (knitted fabric), warp, and weft (woven fabric), and examples of the material include cotton, hemp, wool, silk, polyester, nylon, and acrylic material, of these, polyester, nylon, and acrylic material are preferred, from the viewpoints of durability and cost.

The upper layer 13 preferably has an apparent thickness of 0.5 mm or more, since excellent mechanical properties including mechanical strength and wear resistance can be attained.

So long as toner and other foreign matter can be effectively removed, the upper layer 13 may be formed of a plurality of layers in which a woven fabric layer or a knitted fabric layer are stacked. For producing the upper layer 13 having a multilayer structure, a woven fabric layer and a knitted fabric layer may be stacked. Alternatively, woven fabric layers may be stacked, or knitted fabric layers may be stacked. In the case of stacking woven fabric layers, woven fabric layers made of different materials may be stacked, or those made of the same material may also be stacked.

The upper layer 13 is not limited to the aforementioned structures, and may be formed of pile-weave woven fabric. The pile-weave woven fabric refers to woven fabric made from base yarn with warp or weft for forming piles such that piles (uncut or cut) are incorporated into a surface of the woven fabric.

The upper layer formed of pile-weave fabric preferably has a thickness of 0.5 to 3.0 mm. When the thickness is less than 0.5 mm, deformation of the roller surface is insufficient, whereas when the thickness is more than 3.0 mm, a satisfactory cleaning effect can be attained. However, since a cleaning roller produced therefrom has a large roller diameter, such a cleaning roller is not suited for the purpose of down-sizing a complex OA machine.

The single filament of the pile-weave fabric preferably has a diameter of 5 to 500 dTex, in order to attain strength sufficient for cleaning. When the single filament has a diameter less than 5 dTex, mechanical strength may be poor, whereas when the diameter exceeds 500 dTex, softness of the upper layer 13 is reduced, possibly damaging the contact member. Both cases are not preferred.

The pile-weave fabric preferably has a filament density of 6,400 to 46,000 filaments/$cm^2$. When the filament density falls within this range, the upper layer 13 can sufficiently hold foreign matter.

No particular limitation is imposed on the material of single filaments forming the pile-weave fabric, and examples of the material include polyamide, polyester, acrylic material, and polyolefin.

As mentioned above, when the cleaning roller 10 of the present embodiment is employed, toner and other foreign matter deposited on a contact member are scraped off by means of the upper layer 13. The toner and other foreign matter deposited on the upper layer 13 are held in an adhesive layer of the lower layer 12. Therefore, the cleaning roller 10 of the present embodiment effectively removes toner and other foreign matter on the contact member for a long period of time.

If the cleaning performance of the cleaning roller 10 of the present embodiment is lowered as a result of use over a long period of time, the lower layer 12 is removed from the core member 11. Since the lower layer can be readily removed, the core member 11 can be reused. Through reuse of the core member 11 removed from the cleaning roller 10, another cleaning roller 10 can be produced at lower cost.

The cleaning member of the present invention is suitable for a cleaning roller, particularly for a cleaning roller for removing toner deposited on a charge-imparting roller and a photoreceptor employed in copying machines, printers, facsimiles, etc.

EXAMPLES

The present invention will next be described in detail by way of examples, which should not be construed as limiting the invention thereto.

Example 1

Belt-form knitted fabric made of rayon (apparent fiber thickness: 80 μm, interwarp distance: about 500 μm, interweft distance: about 600 μm, and apparent thickness: 500 μm) was adhered onto one side of a double-faced tape (ultra-strong double-faced tape, product of 3M, thickness: 1.3 mm), formed of an acrylic foam support having an Asker C hardness of 690 and a permanent compressive strain (room temperature) of 13%. The laminated member was wound around a metal shaft (ϕ: 6 mm) so as to affix the other side of the tape onto the metal shaft. The thus-formed roller was cut to pieces having a predetermined length, to thereby produce cleaning rollers of Example 1.

Example 2

The procedure of Example 1 was repeated, except that a double-faced tape (ultra-strong double-faced tape, product of Nitto, thickness: 1.1 mm), formed of a polyethylene foam Support having an Asker C hardness of 58° and a permanent compressive strain (room temperature) of 3%, was used instead of the double-faced tape (ultra-strong double-faced tape, product of 3M), to thereby produce cleaning rollers of Example 2.

Example 3

The procedure of Example 1 was repeated, except that a double-faced tape (ultra-strong double-faced tape, product of 3M, thickness; 0.8 mm), formed of an acrylic foam support having an Asker C hardness of 63° and a permanent compressive strain (room temperature) of 16%, was used instead of the double-faced tape (ultra-strong double-faced tape, product of 3M), to thereby produce cleaning rollers of Example 3.

Example 4

The procedure of Example 1 was repeated, except that a double-faced tape (ultra-strong double-faced tape, product of Teraoka Seisakusho Co., Ltd., thickness: 0.4 mm), formed of an acrylic foam support having an Asker C hardness of 72° and a permanent compressive strain (room temperature) of 10%, was used instead of the double-faced tape (ultra-strong double-faced tape, product of 3M), to thereby produce cleaning rollers of Example 4.

Example 5

The procedure of Example 1 was repeated, except that a double-faced tape (ultra-strong double-faced tape, product of Lintec, thickness: 1.0 mm), formed of a polyolefin foam support having an Asker C hardness of 53° and a permanent compressive strain (room temperature) of 4%, was used instead of the double-faced tape (ultra-strong double-faced tape, product of 3M), to thereby produce cleaning rollers of Example 5.

Example 6

The procedure of Example 1 was repeated, except that a double-faced tape (ultra-strong double-faced tape, product of Sliontec Corporation, thickness: 0.9 mm), formed of an acrylic foam support having an Asker C hardness of 69° and a permanent compressive strain (room temperature) of 13%, was used instead of the double-faced tape (ultra-strong double-faced tape, product of 3M), to thereby produce cleaning rollers of Example 6.

Example 7

A double-faced tape (ultra-strong double-faced tape, product of 3M, thickness: 1.3 mm), formed of an acrylic foam support having an Asker C hardness of 690 and a permanent compressive strain (room temperature) of 13% was spirally wound around a metal shaft (ϕ; 6 mm), to thereby form a lower layer on the shaft. The lower layer was covered with pile-weave fabric made of nylon single filaments (diameter: 110 dTex) (density: 33,000 filaments/$cm^2$, thickness: 1.9 mm). The thus-formed roller was cut to pieces having a predetermined length, to thereby produce cleaning rollers of Example 7.

Example 8

The procedure of Example 7 was repeated, except that pile-weave fabric made of nylon single filaments (diameter: 110 dTex) (density: 27,000 filaments/$cm^2$, thickness: 1.8 mm) was used as woven fabric, to thereby produce cleaning rollers of Example 8.

Example 9

The procedure of Example 7 was repeated, except that pile-weave fabric made of acetate single filaments (diameter: 130 dTex) (density: 19,800 filaments/$cm^2$, thickness: 1.9 mm) was used as woven fabric, to thereby produce cleaning rollers of Example 9.

Example 10

The procedure of Example 7 was repeated, except that pile-weave fabric made of ester single filaments (diameter: 84/2 dTex; i.e., 84-dTex single filament was divided into two) (density: 34,000 filaments/$cm^2$, thickness: 1.9 mm) was used as woven fabric, to thereby produce cleaning rollers of Example 10.

Comparative Example 1

A melamine resin foam piece (product of BASF) was sliced into rectangular pieces. A hole for receiving a core member was provided in one rectangular piece. A core member onto which an adhesive had been applied was inserted to the hole, followed by melt-adhering. Subsequently, the surface of the rectangular piece was polished to a roller shape, and the thus-formed roller was cut to pieces having a predetermined length, to thereby produce cleaning rollers of Comparative Example 1.

Comparative Example 2

An elastic layer was formed around a core member through molding an urethane material, and the surface of the elastic layer was polished. An adhesive (Saivinol HM-680, product of Saiden Chemical Industry Co., Ltd.) was applied onto the polished surface of the elastic layer, and the adhesive side was covered with belt-form knitted fabric as employed in Example 1. The thus-formed roller was cut to pieces having a predetermined length, to thereby produce cleaning rollers of Comparative Example 2.

Steps for producing cleaning rollers of the Examples and the Comparative Examples are shown in Table 1.

TABLE 1

| Step | Examples 1 to 6 | Examples 7 to 10 | Comp. Ex. 1 | Comp. Ex. 2 |
|---|---|---|---|---|
| 1 | Affixing knitted fabric to double-faced tape | Winding double-faced tape around core | Production of polymer foam | Molding to from elastic layer |
| 2 | Winding double-faced tape around core | Affixing woven fabric to double-faced tape | Slicing | Polishing elastic layer surface |
| 3 | Cutting | Cutting | Hole making | Application of adhesive to elastic layer |
| 4 | — | — | Application of adhesive to core | Covering with belt-form knitted fabric |
| 5 | — | — | Surface polishing | Cutting |
| 6 | — | — | Cutting | — |

As is clear from Table 1, as compared with the cleaning rollers of Comparative Examples 1 and 2, the cleaning rollers of the Examples are produced through a smaller number of production steps. Thus, the cleaning roller of the present invention can be produced through reduced production steps and at low cost.

Test Example 1

Each of the cleaning rollers of the Examples and Comparative Example 1 was caused to come into contact with a charge-imparting roller which was in contact with a photoreceptor, at a pressure so as to adjust the deformation of the cleaning roller to 0.1 mm. Thereafter, a toner (about 0.03 g) was uniformly applied onto an area (width; 100 mm) of the charge-imparting roller. The photoreceptor was rotated at 300 rpm by means of a driving motor. In this case, the charge-imparting roller and the cleaning roller rotate to follow the rotation of the photoreceptor.

After operation of the driving motor for 15 minutes, the surface of the charge-imparting roller was observed. When the surface of the charge-imparting roller had been successfully cleaned, the same operation was repeated. In the case where no cleaning effect on the charge-imparting roller was observed, repetition of the operation was stopped. The results are shown in Table 2.

<Type of Toner>

Digital toner (product of Konica Minolta), including styrene resin (6 μm), silicone additive, and titanium oxide (0.6 μm)

TABLE 2

| | Cleaning operation (times) |
|---|---|
| Example 1 | 7 |
| Example 2 | 7 |
| Example 3 | 8 |
| Example 4 | 6 |
| Example 5 | 9 |
| Example 6 | 7 |
| Example 7 | ≧20 |
| Example 8 | ≧20 |
| Example 9 | ≧20 |
| Example 10 | ≧20 |
| Comparative Example 1 | 8 |
| Comparative Example 2 | 9 |

As is clear from Table 2, similar to the cleaning rollers of Comparative Examples 1 and 2, the cleaning rollers of Examples 1 to 6 exhibit excellent cleaning performance with respect to a change-imparting roller or a similar roller for a long period of time. The cleaning rollers of Examples 7 to 10 maintain excellent cleaning performance for a longer period of time, as compared with the cleaning rollers of Comparative Examples 1 and 2.

As described hereinabove, the cleaning member according to the present invention can be produced through a small number of steps and at low cost, and maintains excellent cleaning performance for a long period of time.

What is claimed is:

1. A cleaning member comprising:

a core member, a lower layer formed through winding a double-faced tape around the core member at the surface thereof, and an upper layer provided on the outer surface of the lower layer, wherein the double-faced tape has a sponge member having an adhesive layer on each side thereof, and the upper layer is formed of at least one fiber layer made of woven fabric or knitted fabric.

2. A cleaning member as described in claim 1, wherein the double-faced tape has a thickness of 0.4 to 3.0 mm.

3. A cleaning member as described in claim 1, wherein the sponge member is formed of polyolefin or acrylic rubber.

4. A cleaning member as described in claim 1, wherein the upper layer is formed of a plurality of fiber layers, whose materials are identical to or different from one another.

5. A cleaning member as described in claim 1, wherein the upper layer is formed of a plurality of fiber layers, whose fabric types are identical to or different from one another.

6. A cleaning member as described in claim 1, which has a roller shape.

* * * * *